US005253442A

United States Patent [19]

Kim

[11] Patent Number: 5,253,442

[45] Date of Patent: Oct. 19, 1993

[54] RIFLES WITH MULTI-MAGAZINE HOLDERS

[76] Inventor: Jin-Taek Kim, 71-1 Uopnae-Li, Uljin-Uop, Uljin-Kun, Kyongsangbuk-Do, Rep. of Korea

[21] Appl. No.: 917,172

[22] Filed: Jul. 24, 1992

[30] Foreign Application Priority Data

May 7, 1992 [KR] Rep. of Korea ..... 92-7830

[51] Int. Cl.[5] ..... F41A 9/68

[52] U.S. Cl. ..... 42/50; 89/34; 89/33.1

[58] Field of Search ..... 89/34, 33.5, 33.1; 42/49.01, 49.02, 50, 7, 6

[56] References Cited

U.S. PATENT DOCUMENTS

| | | | |
|---|---|---|---|
| 636,978 | 11/1899 | Garland | 89/34 |
| 2,289,067 | 7/1942 | Owsley | 42/50 |
| 3,019,542 | 2/1962 | Manthos | 89/34 |
| 3,623,256 | 11/1971 | Shiplee, III | 42/50 |
| 4,127,954 | 12/1978 | Hausmann | 42/50 |
| 4,484,403 | 11/1984 | Schwaller | 42/50 |
| 4,580,363 | 4/1986 | Rowe, Jr. | 42/6 |

FOREIGN PATENT DOCUMENTS

| | | | |
|---|---|---|---|
| 573435 | 11/1945 | United Kingdom | 42/50 |

*Primary Examiner*—Stephen M. Johnson

*Attorney, Agent, or Firm*—Lowe, Price, LeBlanc & Becker

[57] ABSTRACT

A rifle provided with a multi-magazine holder for receiving a main magazine and a reserve magazine at the same time. The multi-magazine holder comprises a main magazine holder for receiving the main magazine and at least one subsidiary magazine holder for receiving the reserve magazine and a guide part for integrally connecting the main magazine holder to the subsidiary magazine holder and guiding the reserve magazine from the subsidiary magazine holder to the main magazine holder. The subsidiary magazine holder is integrally formed with the main holder to be parallel thereto and having an inclined snap bolt member which projects on an inner surface of the subsidiary magazine holder to support the reserve magazine and upwardly guide the reserve magazine from the subsidiary magazine holder to the main magazine holder. The guide part integrally extends from the lowermost end of the main magazine holder to the uppermost end of the subsidiary magazine holder and is inclined with respect to the main magazine holder at an inclination angle. The detachable magazine is provided with a snap groove corresponding to the inclined snap bolt member of the subsidiary magazine holder.

4 Claims, 6 Drawing Sheets

RIFLES WITH MULTI-MAGAZINE HOLDERS

BACKGROUND OF THE INVENTION

1. Filed of the Invention

The present invention relates in general to a rifle equipped with a magazine holder for receiving a detachable magazine, and more particularly to a rifle having a multi-magazine holder which comprises a main magazine holder for receiving a main magazine and at least one subsidiary magazine holder for receiving a reserve magazine.

2. Description of the Prior Art

Conventionally, known rifles, wuch as a M-16 military rifle, are integrally equipped with a monomagazine holder for receiving a detachable magazine which is charged with bullets. As shown in FIGS. 1 and 2, the conventional monomagazine holder 4 of the rifle is generally formed as downwardly extending from the main body of the rifle and has a generally rectangular-sectioned hollow shape and is provided at a side surface thereof with a magazine extractor 4*a* elastically biased by a spring member so that the magazine holder 4 can elastically receive a magazine 5 having a generally trapezoidal hexahedral shape. To charge the magazine 5 in the monomagazine holder 4, the magazine 5 charged with bullets is upwardly inserted into the magazine holder 4 until it snaps to the magazine extractor 4*a*. In this state, if a breechblock is retreated and advanced, the uppermost bullet in the magazine 5 is charged in the cartridge chamber of the rifle, thereby getting readied for firing.

To exchange a new magazine for the used magazine, that is, an empty magazine after firing, the used magazine 5 is extracted from the holder 4 by pushing the magazine extractor 4*a* and the new magazine is charged in the holder 4 in the same manner as described above. In result, in exchanging the new magazine for the used magazine, it is required to extract the used magazine by pushing the magazine extractor 4*a*, take the new magazine out of a cartridge belt, conform the insert direction of the new magazine and charge the new magazine in the holder 4 by upwardly inserting it into the holder 4 until it snaps to the magazine extractor 4*a*.

Therefore, the known magazine holder 4 having the above structure has a disadvantage in that the exchange of the new magazine for the used magazine needs a substantially long time regardless of skill of the shooter and makes the shooter to turn his eyes from the shooting target to the magazines, thereby causing the shooter, especially in successive firing, to feel a burdensome.

SUMMARY OF THE INVENTION

It is, therefore, an object of this invention to provide a rifle equipped with a multi-magazine holder in which the above-mentioned disadvantage can be overcome and which is provided with a main holder for receiving a main magazine and a subsidiary holder for receiving at least one reserve magazine, thereby causing the exchange of the new magazine for the used magazine to be carried out for a short time without requirement of turning the shooter's eyes from the target to the magazines.

In an aspect, the present invention provides a rifle comprising a multi-magazine holder having: a main magazine holder for receiving a main magazine being charged with bullets which are to be fed to a cartridge chamber of the refle, said main magazine holder integrally extending from a main body of the refle and having the same structure as the conventional magazine holder; a subsidiary magazine holder for receiving a reserve magazine, said subsidiary magazine holder being integrally formed with said main holder to be parallel thereto and having an inclined snap bolt member which projects on an inner surface of the subsidiary magazine holder to support said reserve magazine in the subsidiary magazine holder and upwardly guide the reserve magazine from the subsidiary magazine holder to the main magazine holder; and a guide part for integrally connecting the main magazine holder to the subsidiary magazine holder and guiding said reserve magazine from the subsidiary magazine holder to the main magazine holder, said guide part integrally extending from the lowermost end of the main magazine holder to the uppermost end of the subsidiary magazine holder and being inclined with respect to the main magazine holder at an inclination angle; and a detachable magazine being provided with a snap groove corresponding to said inclined snap bolt member of the subsidiary magazine holder.

In another aspect of this invention, the subsidiary magazine holder of the multi-magazine holder comprises two subsidiary magazine holders which are opposite to, parallel to and spaced apart from each other with respect to the main holder.

BRIEF DESCRIPTION OF THE DRAWINGS

The above and other objects, features and other advantages of the present invention will be more clearly understood from the following detailed description taken in conjunction with the accompanying drawings, in which:

FIGS. 4A to 4C are sectioned views showing embodiments of a snap bolt member of a subsidiary holder of the rifle in accordance with the present invention, respectively, in which;

FIG. 4A shows a reversed triangular-sectioned bolt slightly projecting on an inner surface of a narrower side surface of the subsidiary magazine holder;

FIG. 4B shows a trapezoidal-sectioned bolt which is disposed in an opening formed at a narrower side wall of the subsidiary holder and biased by a coil spring; and FIG. 4C shows a trapezoidal-sectioned bolt which is disposed in an opening formed at a narrower side wall of the subsidiary holder and biased by an U-shaped plate spring;

FIGS. 5A and 5B are sectioned views showing the exchange of the magazines using the multi-magazine holder of FIG. 3, respectively, in which:

FIG. 5A shows the extraction of the empty magazine from the main holder; and FIG. 5B shows the charge of a reserve magazine from the subsidiary holder to the main holder; and FIGS. 6A to 6C are sectioned views showing another embodiment of a multi-magazine holder equipped to a rifle in accordance with this invention, in which:

FIG. 6A shows the structure of the multi-magazine holder;

FIG. 6B shows the extraction of the empty magazine from the main holder; and

FIG. 6C shows the charge of a reserve magazine from one of the subsidiary magazine holders to the main holder.

DETAILED DESCRIPTION OF THE PREFERRED EMBODIMENTS

Figure 1:
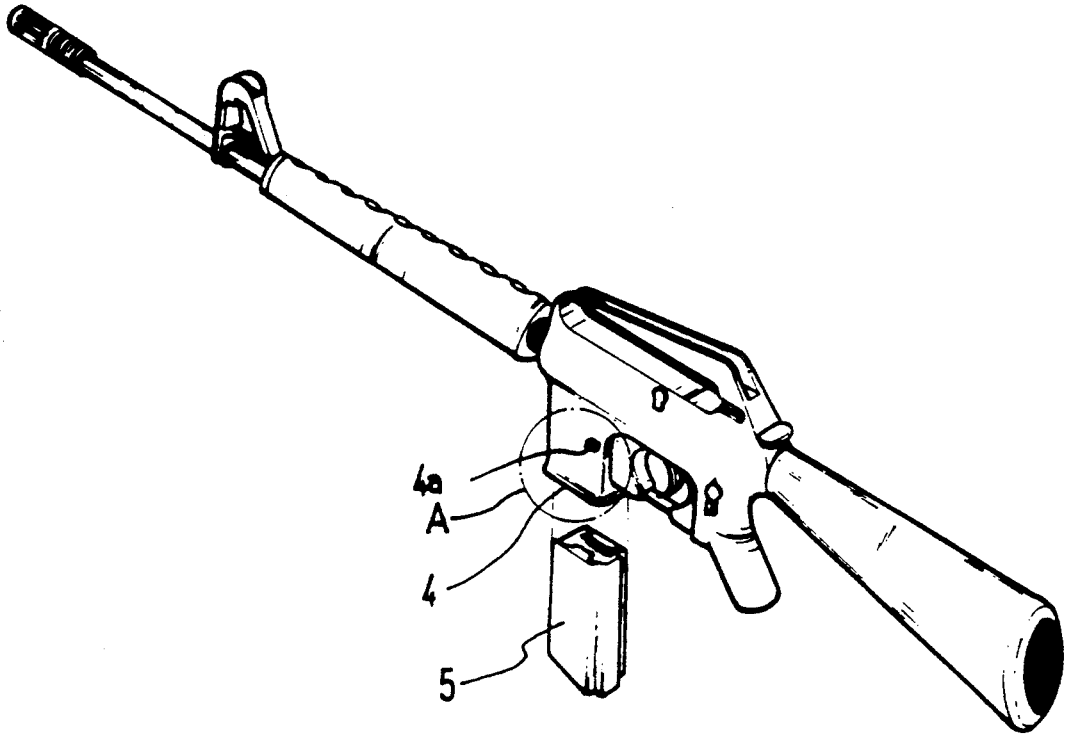
FIG 1 (PRIOR ART)
FIG. 1 is a perspective view showing a known rifle having a monomagazine holder for receiving a detachable magazine.
Figure 2:
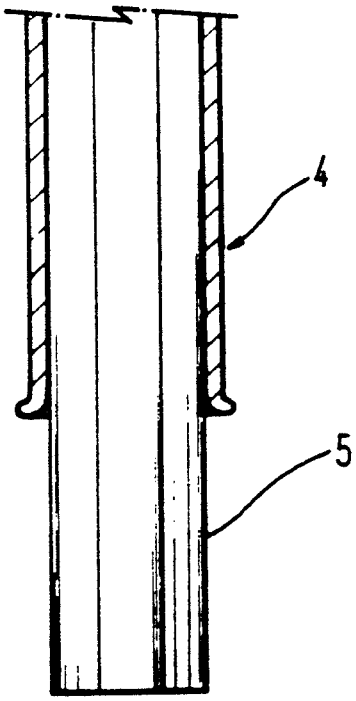
FIG 2 (PRIOR ART)
FIG. 2 is an enlarged schematic view showing a magazine charged in the conventional monomagazine holder of the rifle of FIG. 1.
Figure 3:
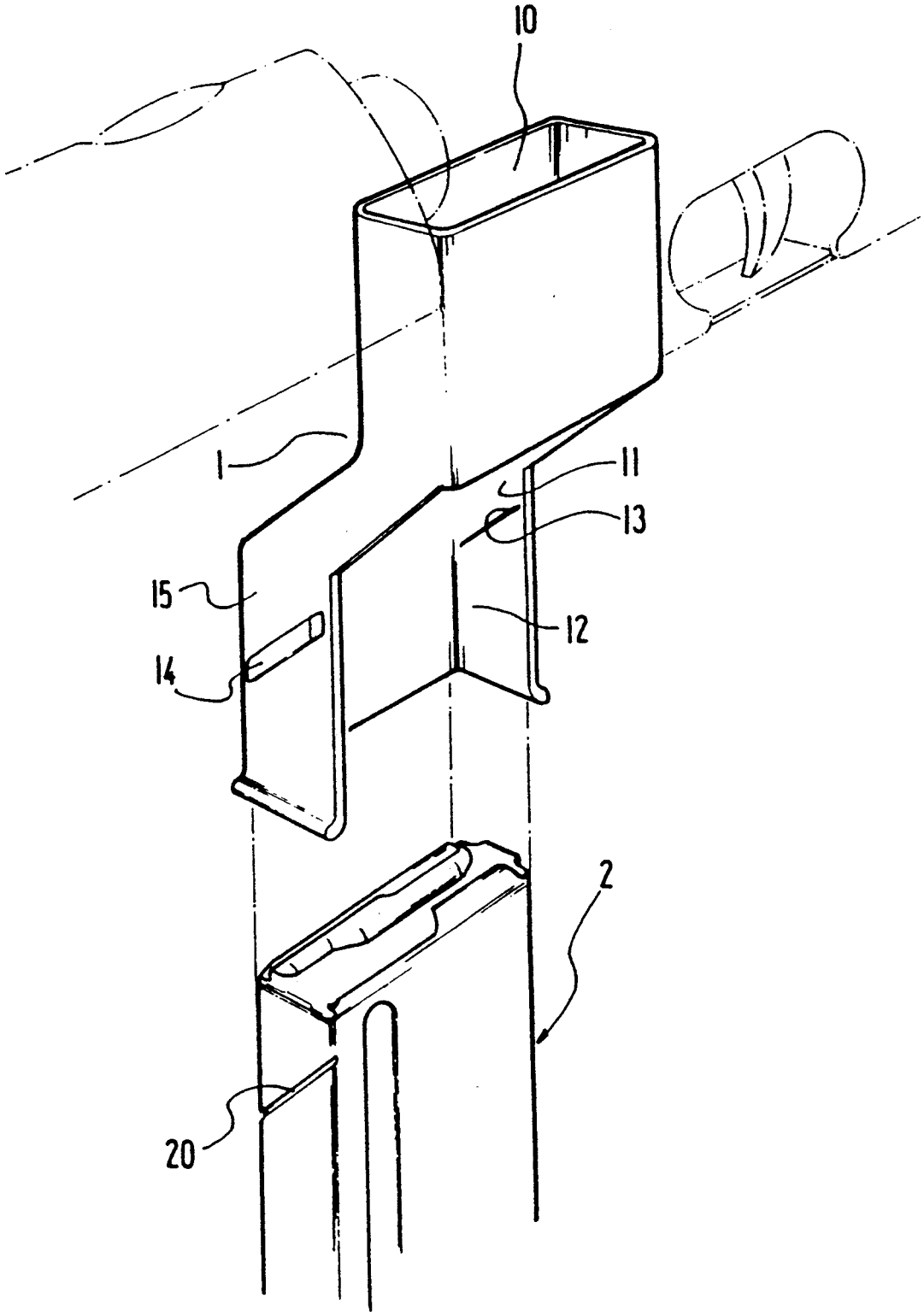
FIG. 3 is a partially enlarged perspective view showing an embodiment of a multi-magazine holder equipped to a rifle in accordance with this invention.

Referring to FIG. 3 which is a partially enlarged perspective view showing an embodiment of a multi-magazine holder integrally equipped to a rifle in accordance with this invention, the multi-magazine holder 1 comprises a main magazine holder 10 (hereinafter, referred to simply as "the main holder.") which integrally, vertically extends from a main body of the rifle, has the same structure as the conventional monomagazine holder and directly communicates with a cartridge chamber of the rifle. In addition to accomplish the object of this invention, a subsidiary magazine holder 12 (hereinafter, referred to simply as "the subsidiary holder") is provided for the multi-magazine holder 1 as being integrally formed with the main holder 10 to be parallel thereto. The subsidiary holder 12 is prepared for a reserve magazine 2, while the main holder 10 is prepared for a main magazine 2.

Between the main and subsidiary holders 10 and 12, a guide part 11 integrally extends from the lowermost end of the three side surfaces of the main holder 10 to the uppermost end of the subsidiary holder 12 so that it causes the holders 10 and 12 to be integrally connected to each other. Here, the guide part 11 is formed as being inclined with respect to a wider vertical surface of the main holder 10 at an inclination angle, preferably at about 45°, which provides a smooth guidance of the reserve magazine in the subsidiary holder 12 to the main holder 10, thereby causing the reserve magazine 2 to be easily guided to the main holder 10 by a slight force. As shown in FIG. 3, the guide part 11 and the subsidiary holder 12 open to a wider side surface thereof, respectively, so that they have an U-shaped cross section, while the main holder 10 has four vertical surfaces encircling the magazine compartment.

Figure 4A:
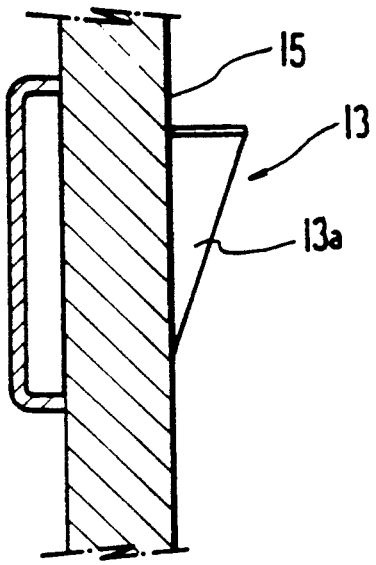
Figure 4B:
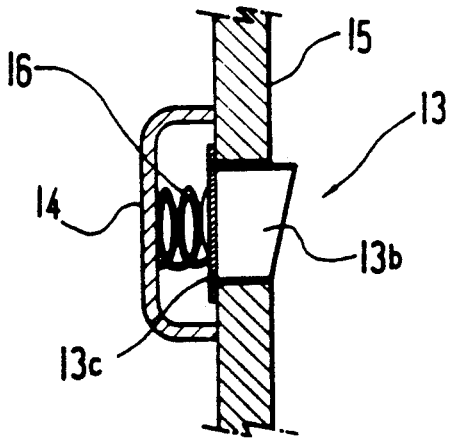
Figure 4C:
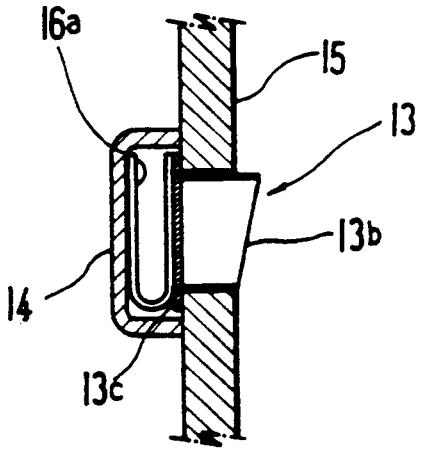

In addition, at each narrower side wall 15 the subsidiary holder 12 includes an inclined snap bolt member 13 which is elastically provided to support the reserve magazine 2 by snapping to a corresponding inclined snap groove 20 formed at each narrower side surface of the magazine 2. The snap bolt member 13 may have a structure shown in FIG. 4A, while it may be formed as having other structures as depicted in FIGS. 4B and 4C. The snap bolt member 13 shown in FIG. 4A is prepared as simply forming a reversed triangular-sectioned bolt **13*a* slightly projecting on an inner surface of the narrower side wall 15 of the subsidiary magazine 12 so that it snaps to the corresponding snap groove 20 of the magazine 2 when the magazine 2 is upwardly inserted into the subsidiary holder 12. In result, the reserve magazine 2 is efficiently prevented from being suddenly dropped from the subsidiary holder 12 due to the mechanical vibration generated in firing but it is easily displaced upwardly as being guided by the snap bolt members 13** when it is required to be exchanged for the used magazine.

On the other hand in accordance with the second embodiment of the snap bolt member 13 shown in FIG. 4B, the snap bolt member 13 may comprise a trapezoidal-sectioned bolt **13*b* which is disposed in an opening formed at the narrower side wall 15 of the subsidiary holder 12 and biased by a coil spring 16 disposed between a casing 14 and a back plate 13*c* of the bolt 13*b*. Also, the trapezoidal-sectioned bolt 13*b* may be biased by an U-shaped plate spring 16*a*** as shown in FIG. 4C.

Figure 6A:
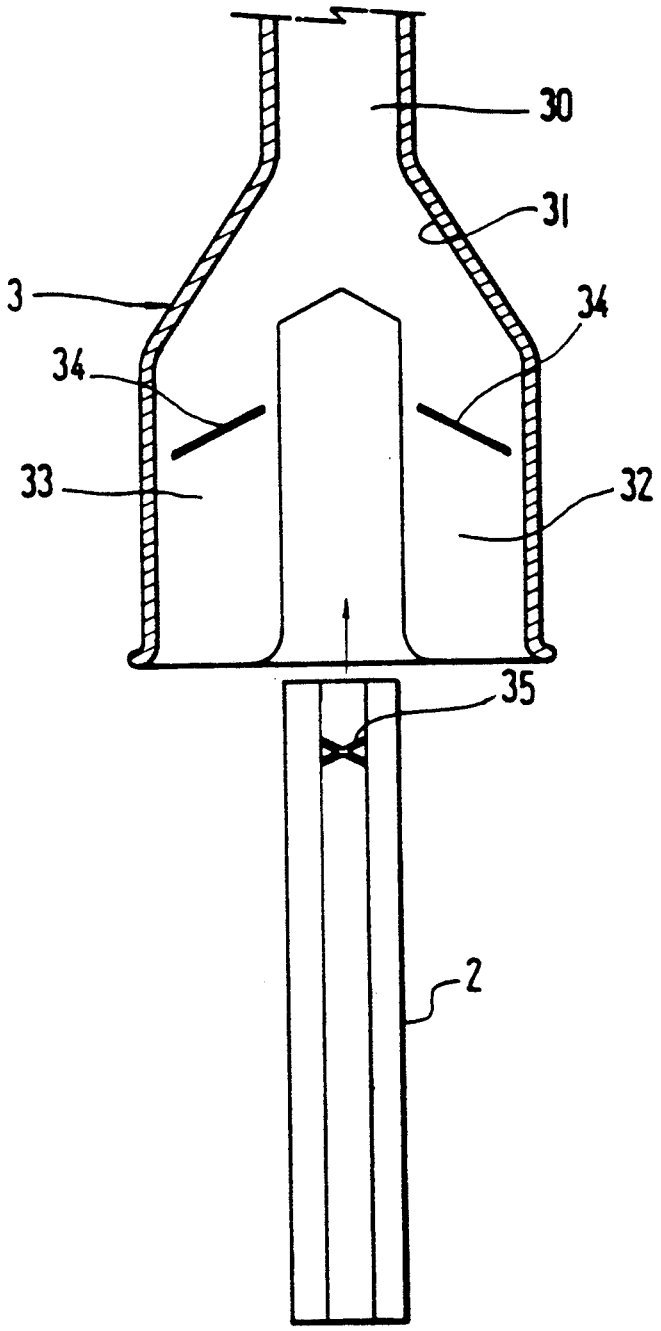
Figure 6B:
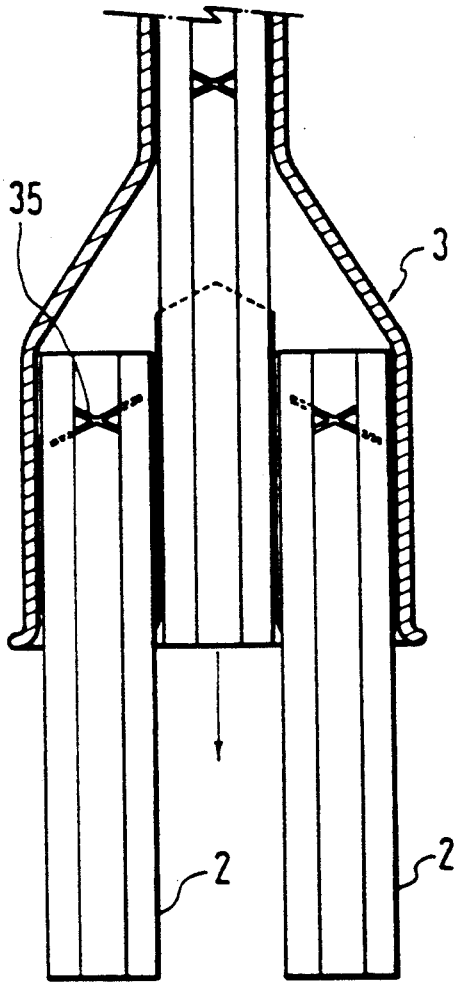
Figure 6C:
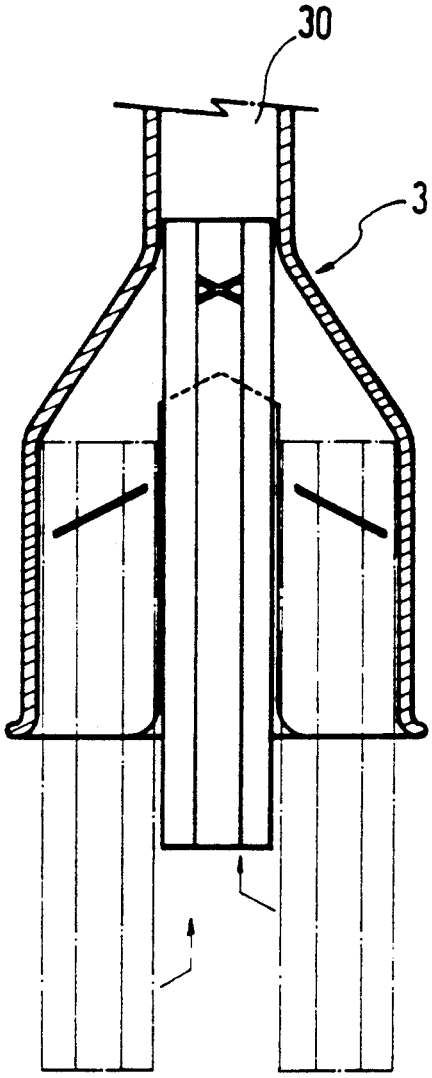

Turning to FIGS. 6A to 6C showing another embodiment of a multi-magazine holder of this invention, the multi-magazine holder 3 may include a pair of subsidiary holders 32 and 33 integrally extending from a main holder 30 which integrally, vertically extends from the main body of the rifle and has the same structure as the conventional magazine holder. The subsidiary holders 32 and 33 are opposite to, parallel to and spaced apart from each other with respect to the main holder 30 and include inclined snap bolt members 34 having the same structure as the aforementioned first embodiment, respectivlly. In the same manner as the first embodiment, a guide part 31 integrally extends from the lowermost end of the main holder 10 to the uppermost end of each subsidiary holder 32 or 33. The guide part 31 has the same inclination angle as the first embodiment.

In this second embodiment, the subsidiary holders 32 and 33 are provided with the inclined snap bolt members 34, respectively, so that the magazine 2 corresponding to the subsidiary holder 32, 33 has a corss-shaped snap groove 35 formed at each narrower side surface thereof. In result, it is possible to charge the reserve magazine 2 having the corss-shaped snap groove 35 in the subsidiary holders 32 and 33 regardless of the position of the subsidiary holders 32 and 33.

Figure 5A:
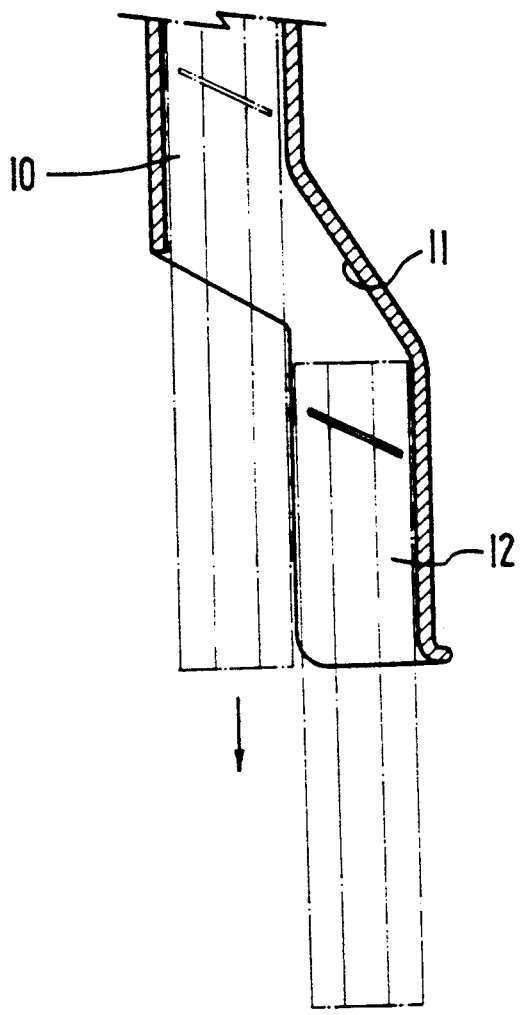
Figure 5B:
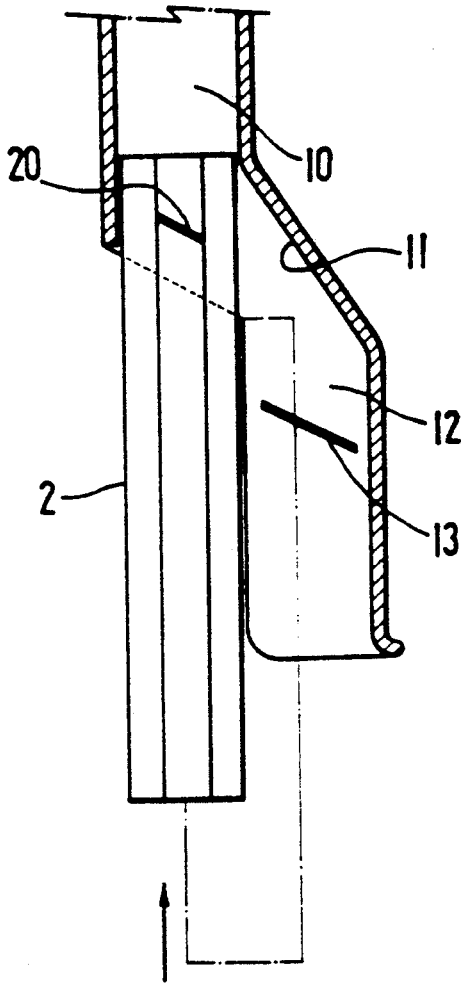

In operation of the multi-magazine holder 1 having the structure shown in FIG. 3, a magazine 2 is charged in the main holder 10 and another magazine 2 as a reserve magazine is charged in the subsidiary holder 12, thereby achieving the charge of the two magazines 2 in the multi-magazine holder 1 at the same time as shown in FIG. 5A. After firing, the used magazine 2, that is the empty magazine, is extracted from the main holder 10 by pushing the magazine extractor **4*a* and the reserve magazine 2 in the subsidiary holder 12 is then upwardly pushed as shown in FIG. 5B so that the both inclined snap grooves 13 of the reserve magazine 2 is upwardly guided by the snap bolt members 13 of the subsidiary holder 12, thereby causing the reserve magazine 2 to be guided to the main holder 10 by way of the guide part 11 and to be charged in the main holder 10. In this case, to exchange a new magazine 2 for the used magazine, it is not required to take a new magazine out of a cartridge belt and to conform the insert direction of the new magazine but to extract the used magazine 2 from the main holder 10 and upwardly push the reserve magazine 2 in the subsidiary holder 12. In result, there needs a short time in exchanging the new magazine for the used magazine, thereby preventing the shooter from feeling a burdensome in exchanging the magazine 2. Furthermore in exchanging the magazine 2, it is not required to turn the shooter's eyes from the shooting target to the new magazine 2** and this provides an advantage in that the shooter especially in night firing continues close observation of the front while he exchanges the new magazine for the used magazine.

One the other hand in operation of the multi-magazine holder 3 having the structure shown in FIGS. 6A to 6C, a magazine 2 is charged in the main holder 30 and two reserve magazines 2 are charged in the pair of subsidiary holders 32 and 33, respectively, so that the three magazines 2 are charged in the multi-magazine holder 3 at the same time as shown in FIG. 6B. After firing, the used magazine 2 is extracted from the main holder 30 by pushing the magazine extractor 4a and one of the reserve magazines 2 in the subsidiary holders 32 and 33 is upwardly pushed as shown in FIG. 6C. In result, the reserve magazine 2 is charged in the main holder 30 in the same manner as described above. After firing using the charged reserve magazine 2, the empty magazine 2 is extracted from the main holder 30 and the other reserve magazine 2 in the subsidiary holder 32 or 33 is upwardly pushed to be charged in the main holder 30.

As described above, the present invention provides a rifle integrally provided with a multi-magazine holder which comprises a main holder, which integrally, vertically extends from a main body of the rifle, has the same structure as the conventional magazine holder and directly communicates with a cartridge chamber of the rifle, at least one subsidiary holder integrally formed with the main holder to be parallel thereto. Between the main and subsidiary holders, a guide part integrally extends from the lowermost end of the main holder to the uppermost end of the subsidiary holder. In this rifle, besides a main magazine charged in the main holder, at least one reserve magazine is charged in the subsidiary holder. The reserve magazine is, therefore, exchanged for the empty main magazine after firing in a simple process comprising extracting the empty magazine from the main holder by pushing a magazine extractor and upwardly pushing the reserve magazine in the subsidiary holder to be charged in the main holder. In result, this rifle provided with the multi-magazine holder provides an advantage in that the exchanging process of the magazine is carried out for a sorter time in comparison to the conventional process comprising extracting the empty magazine from the main holder, taking a new magazine out of a cartridge belt, conforming the insert direction of the new magazine and charging the new magazine in the holder by upwardly inserting it into the holder. Furthermore because the reserve magazine is easily exchanged for the empty magazine for a short time as described above, the shooter in successive firing exchanges the magazine for a short time, for example, within about 0.5 seconcd, without turning his eyes from the shooting target to the magazine.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A rifle comprising:

a multi-magazine holder having:

a main magazine holder for receiving a main magazine being charged with bullets which are to be fed to a cartridge chamber of the rifle, said main magazine holder integrally extending from a main body of the rifle;

a subsidiary magazine holder for receiving a reserve magazine, said subsidiary magazine holder being integrally formed with said main magazine holder and parallel thereto and having an inclined snap bolt member which projects from an inner surface of the subsidiary magazine holder; and a guide part for integrally connecting the main magazine holder to the subsidiary magazine holder and guiding said reserve magazine from the subsidiary magazine holder to the main magazine holder, said guide part integrally extending from a lowermost end of the main magazine holder to an uppermost end of the subsidiary magazine holder and being inclined with respect to the main magazine holder at an inclination angle; and said reserve magazine being provided with a snap groove corresponding to said inclined snap blot member of the subsidiary magazine holder.

2. A rifle according to claim 1, wherein said subsidiary magazine holder comprises two subsidiary magazine holders which are opposite to, parallel to and spaced apart from each other with respect to said main magazine holder.

3. A rifle according to claim 1, wherein said inclined snap bolt member of the subsidiary magazine holder comprises a reverse triangle-sectioned bolt projecting from said inner surface of the subsidiary magazine holder.

4. A rifle according to claim 1, wherein said inclined snap bolt member of the subsidiary magazine holder comprises a trapezoidal-sectioned bolt which is disposed in an opening formed in a side wall of the subsidiary magazine holder and is biased by a biasing member.

* * * * *